US008296881B2

(12) United States Patent
Litman

(10) Patent No.: US 8,296,881 B2
(45) Date of Patent: Oct. 30, 2012

(54) PLAY SYSTEM FOR CHILDREN, INCLUDING PLAYMAT AND PLAYPIECES

(75) Inventor: Gili Litman, Kfar Daniel-Doar-Na Merkaz (IL)

(73) Assignee: Gymbox Ltd., Kfar Daniel (IL)

( * ) Notice: Subject to any disclaimer, the term of this patent is extended or adjusted under 35 U.S.C. 154(b) by 617 days.

(21) Appl. No.: 12/594,220

(22) PCT Filed: Apr. 1, 2008

(86) PCT No.: PCT/IL2008/000452

§ 371 (c)(1), (2), (4) Date: Oct. 1, 2009

(87) PCT Pub. No.: WO2008/120212

PCT Pub. Date: Oct. 9, 2008

(65) Prior Publication Data

US 2010/0115698 A1 May 13, 2010

(30) Foreign Application Priority Data

Apr. 1, 2007 (IL) ..... 182361

(51) Int. Cl.
*A47G 9/06* (2006.01)

(52) U.S. Cl. ..... 5/420; 5/655

(58) Field of Classification Search ..... 5/655, 98.1, 5/420, 418

See application file for complete search history.

(56) References Cited

U.S. PATENT DOCUMENTS

| | | | | |
|---|---|---|---|---|
| 4,141,588 A | | 2/1979 | Anderson | |
| 4,441,221 A | * | 4/1984 | Enste et al. | 5/657 |
| 4,905,990 A | | 3/1990 | DeSantis | |
| 5,066,001 A | | 11/1991 | Wilkinson | |
| 5,370,460 A | | 12/1994 | Nelson | |
| 5,473,785 A | * | 12/1995 | Lager et al. | 5/655 |
| 5,816,980 A | | 10/1998 | Myszka et al. | |
| 6,001,020 A | | 12/1999 | Nagelski et al. | |
| 6,199,230 B1 | | 3/2001 | Parikh | |
| 6,408,463 B1 | * | 6/2002 | Palacio | 5/424 |
| 6,705,977 B1 | | 3/2004 | Ziak | |
| 7,018,267 B2 | | 3/2006 | Delaney et al. | |
| 7,117,552 B2 | | 10/2006 | Hoffman | |

(Continued)

FOREIGN PATENT DOCUMENTS

GB 2194452 3/1988

(Continued)

OTHER PUBLICATIONS

International Search Report Dated Nov. 13, 2008 From the international Searching Authority Re.: Application No. PCT/IL08/00452.

(Continued)

*Primary Examiner* — Fredrick Conley

(57) ABSTRACT

A play system for children, includes a playmat constructed and dimensioned so as to be foldable from a flat condition for normal use as a mat, to a folded condition defining a receptacle; and a plurality of play pieces for use on the playmat when in its flat condition, and adapted to be received within the receptacle defined by the playmat when in its folded condition. The playmat, and at least some of the play pieces, include mateable fastener elements for releasably retaining the play pieces on the playmat when in its flat condition. Fastener elements are located on the playmat at preselected locations thereon to thereby locate and stabilize the play pieces carrying mateable fastener elements at the preselected locations.

20 Claims, 8 Drawing Sheets

U.S. PATENT DOCUMENTS

| | | | | |
|---|---|---|---|---|
| 7,409,733 | B2 * | 8/2008 | Tharalson et al. | 5/98.1 |
| 2005/0048871 | A1 | 3/2005 | Brown | |
| 2006/0169691 | A1 | 8/2006 | Rothschild et al. | |

FOREIGN PATENT DOCUMENTS

| | | |
|---|---|---|
| GB | 2265318 | 9/1993 |
| WO | WO 2008/120212 | 10/2008 |

OTHER PUBLICATIONS

Written Opinion Dated Nov. 13, 2008 From the International Searching Authority Re.: Application No. PCT/IL08/00452.

International Preliminary Report on Patentability Dated Dec. 23, 2009 From the International Bureau of WIPO Re.: Application No. PCT/IL2008/000452.

* cited by examiner

PLAY SYSTEM FOR CHILDREN, INCLUDING PLAYMAT AND PLAYPIECES

RELATED APPLICATIONS

This application is a National Phase Application of PCT Patent Application No. PCT/IL2008/000452 having International Filing Date of Apr. 1, 2008, which claims priority from Israel Patent Application No. 182361, filed on Apr. 1, 2007. The contents of the above Applications are all incorporated herein by reference.

FIELD AND BACKGROUND OF THE INVENTION

The present invention relates to a play system for children, and particularly to a play system of the type comprising a playmat and a plurality of play pieces of soft material for use on a playmat when the playmat is in its flat condition.

It is known, for example as described in British Patent GB2265318, to provide such play systems with a playmat constructed and dimensioned so as to be foldable from a flat condition for normal use as a playmat with the play pieces, or to a folded condition defining a receptacle for storing or shipping the play pieces and playmat. Such a construction thus provides a convenient and compact storage arrangement for storing the play pieces and the playmat when the play pieces are not being used, and also for transporting the playmat and play pieces from one location to another.

Play systems of this type have been found to have interest-generating and educational value with respect to children of certain age groups. Many such systems are available to the public with a wide variety of play pieces that may be selected according to the respective age group, and the particular educational or interest-generating effect desired to be produced.

OBJECT AND BRIEF SUMMARY OF THE PRESENT INVENTION

An object of the present invention is to provide a play system of the foregoing type, but having enhanced value in the physical and mental development of small children, particularly of toddlers up to three years of age.

According to a broad aspect of the present invention, there is provided a play system, comprising: a playmat constructed and dimensioned so as to be foldable from a flat condition for normal use as a mat, to a folded condition defining a receptacle; and a plurality of play pieces for use on the playmat when in its flat condition, and adapted to be received within the receptacle defined by the playmat when in its folded condition; the playmat, and at least some of the play pieces, including mateable fastener elements for releasably retaining the play pieces on the playmat when in its flat condition; the fastener elements on the playmat being located at preselected locations thereon to thereby locate and stabilize the play pieces carrying mateable fastener elements at the preselected locations.

According to a further preferred feature, at least some of the play pieces are of different colors and at least some of the fastener elements on the playmat are of correspondingly different colors, such that the fastener elements on the playmat also indicate the proper playpiece to be releasably attached to the playmat at the respective location on the playmat.

In the described preferred embodiment, the fastener elements are hook-and-loop fastener elements, such as the "Velcro"™ fastener. However, it will be appreciated that other fasteners could be used, such as buttons, clips, snap-fasteners, etc. In the described preferred embodiment, the hooks of the fastener elements are on the lower surfaces of the play pieces, whereas the loops of the fastener elements are on the upper surface of the playmat so as not to affect the softness and comfortable feel of the playmat in its open condition.

According to a still further feature in the described preferred embodiment, the playmat is configured such that in its folded condition it defines a closed, six-sided receptacle, preferably of cubicle configuration having six equal sides. In the described preferred embodiment, the playmat includes first, second, third and fourth panels of equal dimensions pivotally secured to each other in a linear array in the flat condition of the playmat, to define four sides of the receptacle in its folded condition; and two further panel pivotally secured to opposite sides of the third panel to define the remaining two sides of the receptacle in its folded condition.

According to further described features, one face of the first panel, and the opposite face of the fourth panel, carry mating fastener elements for releasably retaining the playmat in its folded condition. In addition, free edges of at least some of the panels include flaps carrying fastener elements on one face cooperable with fastener elements carried the opposite face of the panels to be contiguous thereto in the folded condition of the playmat.

As will be described more particularly below, a play system constructed in accordance with the foregoing features has great educational value, as well as interest-generating value, for small children, since it facilitates making an optimum arrangement of play pieces on the playmat to enhance many aspects in the physical development of the children users, including movements, coordination, balancing, etc., and also to attract their interest. In addition, the play pieces are constructed and dimensioned so as to permit them to be displayed in an optimum arrangement for home use, and to be stored in a compact form for home storage or transportation.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF A PREFERRED EMBODIMENT

Figure 1:
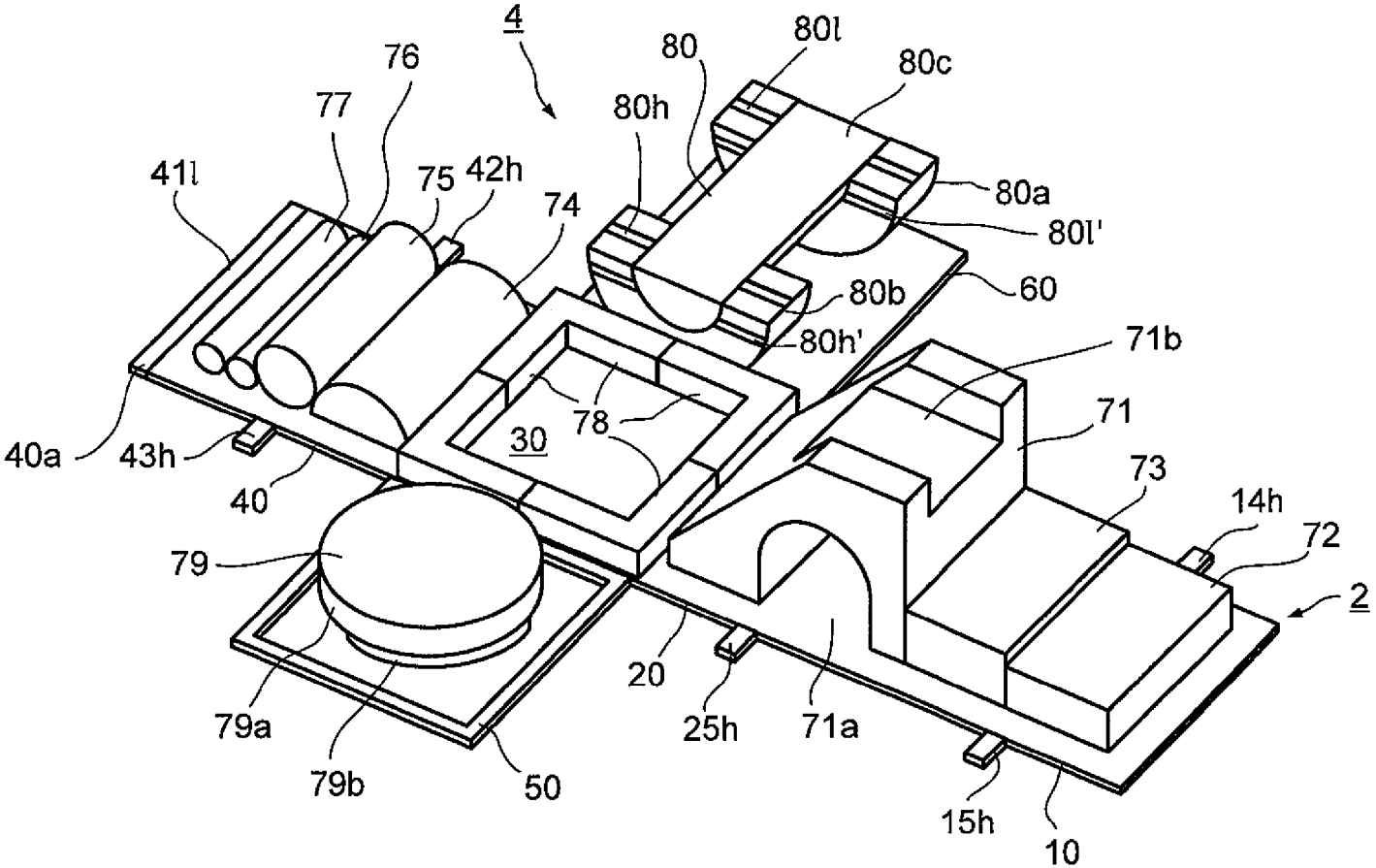
FIG. 1 illustrates, in three-dimensional form, one form of play system constructed in accordance with the present invention, including a playmat, shown in its flat condition, and a plurality of play pieces located thereon in a preselected desired arrangement, to attract child interest and to enhance many aspects in child development, including crawling movements, walking movements, coordination, balancing, etc.
Figure 2:
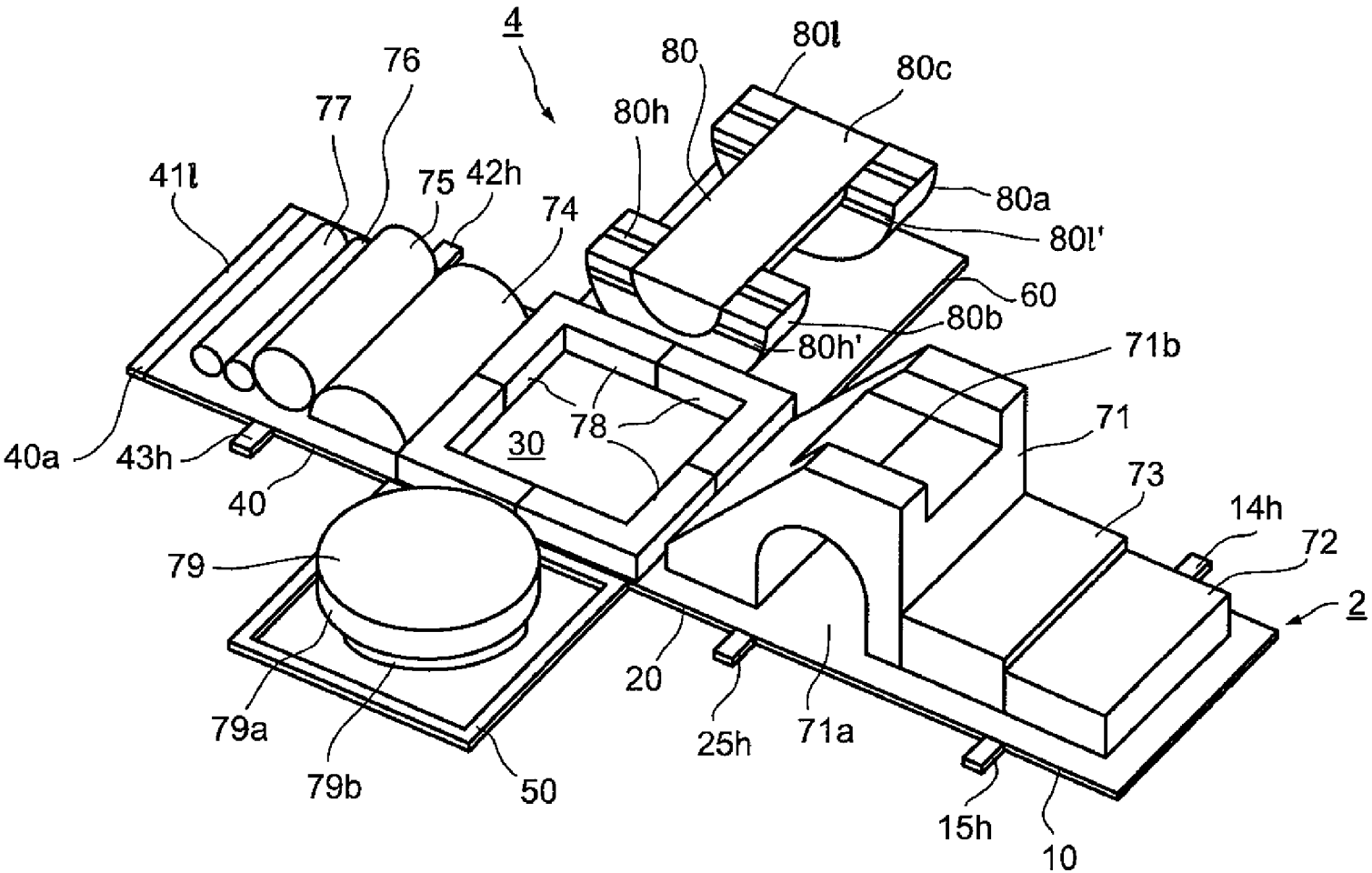
FIG. 2 (in color) illustrates the play system of FIG. 1 with its various play pieces of different colors to indicate their preferred locations on the playmat.
Figure 5:
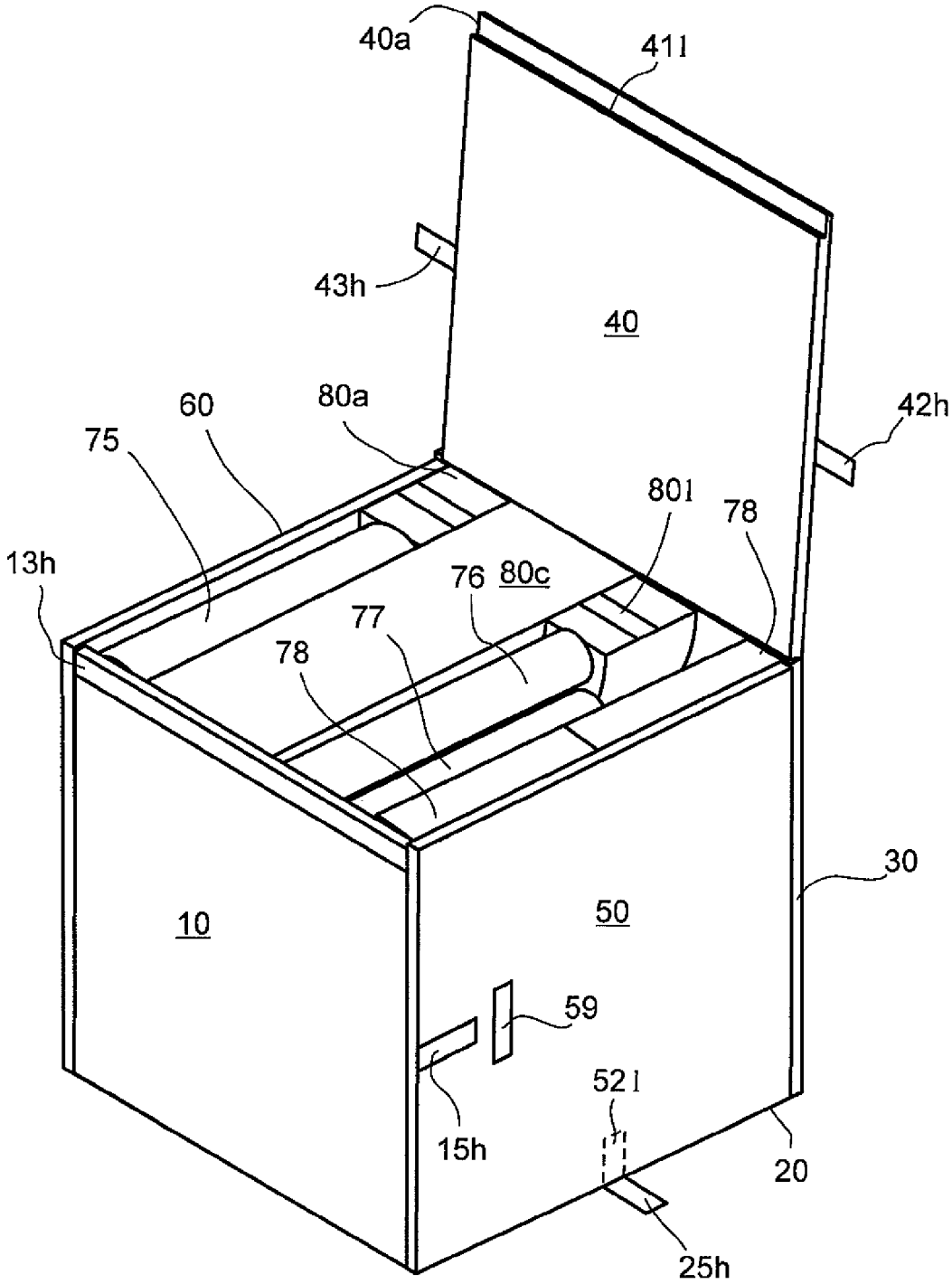
FIG. 5 illustrates the play system of FIGS. 1-4 with the play pieces assembled within the playmat, before the panel of the playmat defining the closure lid, is closed for compact storage or convenient transportation.

FIG. 1 and FIG. 2 (in color) illustrate a play system constructed in accordance with the present invention in the normal deployed form of the system for use by children, particularly toddlers up to three years of age. The illustrated play system includes a playmat, generally designated 2, and a plurality of play pieces generally designated 4. The playmat 2 is constructed and dimensioned so as to be foldable from a flat condition for normal use as a playmat as shown in FIG. 1, to a folded condition as shown in FIG. 5. When the playmat 2 is in its folded condition, it defines a receptacle for receiving the plurality of play pieces 4, and thus provides a compact arrangement for storing and/or transporting the complete play system.

As briefly indicated above, and as will be described more particularly below, the playmat 2, and at least some of the play pieces 4, include mateable fastener elements for releasably retaining the play pieces on the flat playmat. The fastener elements are located at preselected locations on the playmat to thereby locate the play pieces, carrying the mateable fastener elements, at the preselected locations, and to releasably retain or stabilize them at the respective location. Thus, the play pieces may be located according to an optimum arrangement to enhance many aspects in the physical development of children, particularly toddlers up to three years of age, including various movements, coordination, balancing, etc., and also to attract their interest in the play pieces. The play pieces in the illustrated system are constructed and dimensioned for use in the home (as distinguished from a public play area) and for storage in the home.

In the example illustrated in the drawings, playmat 2 is constituted of six panels or sections 10-60, respectively, pivotally joined to each other at contiguous edges, to permit the playmat to be unfolded to the flat condition illustrated in FIGS. 1-4, or to the folded condition illustrated in FIGS. 5 and 6*a*-6*c* defining a receptacle for receiving the play pieces 4. For purposes of example, the play pieces 4 illustrated in FIG. 1 include: a slide 71, a low step 72 and a higher step 73 to be located on one side of the inner panel 30; a semi-cylinder 74, and three smaller cylinders 75, 76, 77 to be located on the opposite side of the inner panel 30; a plurality of frame pieces 78 to be located along its outer periphery of panel 30; a rocker seat 79 to be located on panel 50 at one side of panel 30; and a balancing board 80 to be located on panel 60 at the opposite side of panel 30.

The playmat 2, as well as the play pieces 4, may be of a soft material, such as foamed rubber or plastic, enclosed within a fabric or plastic covering. The play pieces 4 would be light enough to enable children to move them around so as to provide various arrangements for encouraging stepping, sitting, crawling, balancing or other movement activities. As indicated earlier, the educational value of such a play system is substantially enhanced by the present invention, wherein at least some of the play pieces 4, and at least some of the panels 10-60 of the playmat 2, include mateable or interlockable fastener elements for releasably retaining the play pieces on the playmat in specific locations preselected to enhance the educational value of the play system.

Figure 3:
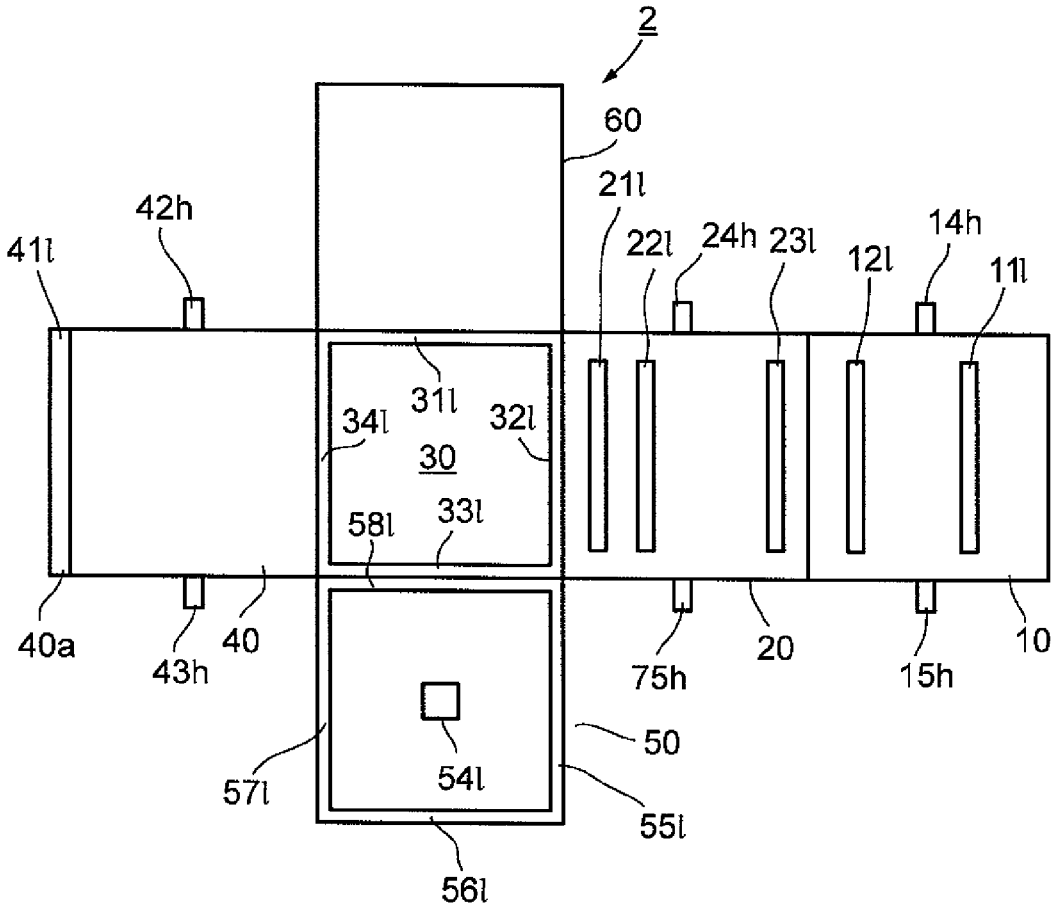
FIGS. 3 and 4 are plan views illustrating the upper and lower surfaces, respectively, of the playmat of FIG. 1 in its flat condition, and particularly showing the fastener elements thereon for locating the play pieces in preselected positions on the playmat and for releasably retaining them in the preselected positions.

In the example illustrated in FIG. 1, and as shown particularly in FIG. 3, all the play pieces 4, except play pieces 74-77 and balancing board 80, include such mateable fastener elements to fix the respective play pieces in optimum preselected locations on the playmat. Play pieces 74-77 do not include such fastener elements, as they are intended to be freely rollable or movable on the mat to encourage crawling and similar body movements. Semi-cylinder 74 is intended to be placed at the desired location with respect to play pieces 75-77, and since it has a flat under surface, it would be relatively stable in such position. Balancing board 80 does not include fastener elements mateable with fastener elements on the playmat since that board is to be freely rockable on the playmat to encourage balancing movements by the toddlers.

In the illustrated example, the mateable fastener elements between the playmat and the play pieces are in the form of hook-and-loop fasteners, e.g., fasteners available under the trademark "Velcro"(™). Such fasteners are releasably fastened together by hooks formed in one element, receivable within loops formed in the other element.

Figure 4:
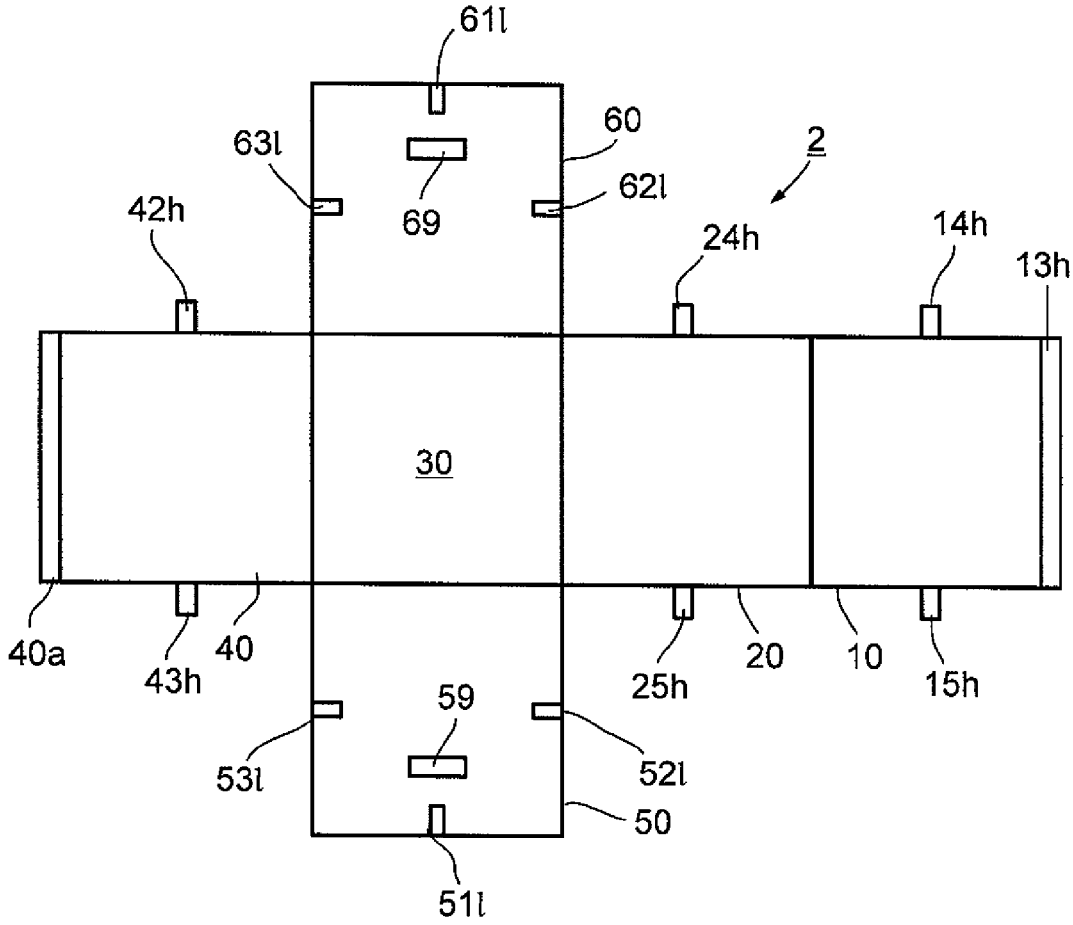

As seen in FIGS. 3 and 4, all six panels 10-60 of playmat 2 are of equal dimensions so that, when the playmat is in its folded condition, it defines a cube having six equal sides, as shown particularly in FIG. 5. Four of the panels, namely panels 10-40, are arranged in a linear array to define four sides of the receptacle in the folded condition of the playmat, whereas the other two panels 50, 60 are pivotally joined to the opposite side of the inner panel 30, to define the remaining two sides of the receptacle in the folded condition of the playmat.

FIGS. 3 and 4 illustrate the opposite surfaces of a playmat 2 constructed in accordance with the present invention to be used with the play pieces 4 illustrated in FIGS. 1 and 2. In this example, all the play pieces 4 (except play pieces 74-77 and balancing board 80) include the "hooks" on their lower surfaces to be applied to the upper surface of the playmat 2, whereas the upper surface of the playmat includes the "loops" in selected locations for receiving the "hooks" of the play pieces. The "loops" are relatively soft and flexible, and are therefore provided on the upper surfaces of the playmat so as to present a soft and comfortable feeling when contacted by the skin. On the other hand, the "hooks" are relatively stiff, and are therefore generally provided on the under surface of the play pieces so as not to be engageable with the user during the normal use of the play system.

All six panels 10-60 are squares having sides of equal dimensions, e.g. 80 cm, except for end panel 40, which includes an extension 40*a*, foldable over the end of panel 10 when folding the mat into the folded condition as shown in FIG. 5. For example, extension 40*a* could be an additional 5 cm. As to be described below, its upper surface is provided with a strip of loop fasteners engageable with a strip of hook fasteners on the under side of panel 10 when folding the mat into its folded condition illustrated in FIG. 5.

Playmat 2, as illustrated particularly in FIGS. 3 and 4, further includes several edge flaps or tabs carrying fastener elements. These are used for retaining the playmat in its folded condition, as illustrated in FIG. 5, to enable the playmat to serve as a receptacle or container for receiving the play pieces 4 for purposes of storage or transportation.

In FIGS. 3 and 4 the elements of playmat 2 which include the "loops" are identified by numbers ending with the letter "1" (loop), whereas those elements which include the "hooks" are identified by numbers ending with the letter "h" (hook).

As shown in FIG. 3, panel 10 includes two linear strips 111, 121, of "loops" for receiving the "hooks" (not shown) on the bottom surface of the two steps 72, 73 of FIG. 1. As shown in FIG. 4, the outer edge of panel 10 includes, on its under surface, a strip 13*h* of hooks for engagement with a corresponding strip 411 of loops (FIG. 3) on the upper surface of panel 40 extension 40*a* for securing the playmat in its folded condition, as illustrated in FIG. 5.

Panel 10 further includes a pair of flaps 14*h*, 15*h*, formed with hooks on their upper surfaces, cooperable with loop strips 611 and 511 formed on under surfaces of panels 50 and 60, respectively, for retaining the playmat in its folded condition.

Panel 20 includes on its upper face three linear strips 211, 221, 231, each formed with loops, for engagement with one of three strips of hooks (not shown) on the lower surface of slide 71, for releasable retaining the slide in the position illustrated in FIGS. 1 and 2. Panel 20 further includes two flaps 24*h*, 25*h*, formed with hooks cooperable with loop strips 621 and 521 (FIG. 4) formed on under surfaces of panels 50, 60, in the folded condition of the playmat.

Inner panel 30 is bounded on each of its four sides by another panel (20, 50, 40, 60, respectively) in the flat condition of the playmat, and therefore does not include any flaps to retain the playmat in the folded condition. Panel 30, however, is formed on its upper surface with a linear strip of loops 311-341 along its outer periphery. These loops are cooperable with hooks (not shown) formed on the under surfaces of the frame pieces 78, for releasably attaching those frame pieces to the playmat in its flat condition.

The upper surface of panel 40 includes two flaps 42*h*, 43*h*, on its opposite sides, engageable with loop strips 631 and 531 in the under surfaces of panels 50 and 60, respectively, in the folded condition of the playmat.

Panel 50 further includes a square region 541 formed with loops, cooperable with hooks formed on the under face of seat 79 in FIG. 1, to releasable retain the seat thereon in the open condition of the playmat. Panel 50 further includes a linear strip of four loop fasteners 551-581 along its four sides, mateable with hook fasteners (not shown) carried by the under surfaces of the frame pieces 78 (FIG. 1). Handles 59 and 69 may be formed on the center surface of panels 50 and 60, respectively, to facilitate handling of the play system, when the play pieces are stored within the playmat in its folded condition to serve as a receptacle.

It will thus be seen, that when the playmat 2 is unfolded to its open condition as illustrated in FIG. 1, the arrangement of the loops in the various panels of the playmat specify the preselected locations of the various play pieces 4 to be applied onto the mat. Such an arrangement thus enables the play pieces to be located at preselected positions on the playmat to enhance many aspects in the physical development of the child, for example child movements, coordination, balancing, etc., and also to attract the child's interest in the play pieces.

Thus as noted above, slide 71 includes, on its bottom surface, three spaced strips of hook fastener elements mateable with the three strips of loop fastener elements 211, 221, 231 on playmat panel 20 in order to properly locate and retain the slide in that location. The bottom surface of slide 71 is further formed with a transversely-extending opening 71*a* configured to serve as a crawl-through tunnel in the flat condition of the playmat, and as a socket for receiving one of the play pieces in the folded condition of the playmat. In addition, the upper surface of slide 71 is formed with a longitudinally-extending opening 71*b* configured to serve as a seat for the child when using the slide in the flat condition of the playmat, and as another socket for receiving another of the play pieces in the folded condition of the playmat. For example, step 73 and semi-cylinder 74 may be dimensioned to be received within socket 71*a*, and step 72 may be dimensioned to be received within socket 71*b* in the folded condition of the playmat.

Seat 79 may be a rockable seat constituted of an upper section 79*a* of circular configuration, and a base 79*b* of smaller diameter than the seat. Base 79*b* carries on its under surface, the hook fastener elements 79*h* (FIG. 6*a*) mateable with the loop fastener elements 541 (FIG. 3) on panel 50 of the playmat, and is deformable to permit rocking the seat. The two sections 79*a*, 79*b* may be integrally formed as one unit, but preferably are formed as separable section for compact storage, and are attachable together for use by other mateable hook-and-loop fasteners (not shown).

Balancing board 80 includes two sections 80*a*, 80*b*, of semi-cylindrical configuration so as to have rounded bottom surfaces for rockably engaging the playmat in its flat condition. The upper surfaces of sections 80*a*, 80*b* are flat and are formed with recesses for receiving a third section 80*c*, also of semi-cylindrical configuration, and also having a flat upper surface. Thus, balancing board 80 may be assembled in the condition illustrated in FIG. 1, with the upper surfaces of all three sections flush, to support the child in a rockable manner on playmat panel 60, and may then be disassembled to permit the sections to be stored in a compact form within the receptacle defined by the playmat in its folded condition.

As indicated earlier, the under surface of balancing board 80 does not include any fastener strips, since it should be freely rockable on the playmat. However, the upper surfaces of the two end sections 80*a*, 80*b*, may be provided with complementary hook-and-loop fastener strips as shown at 80*h* and 80*l*, and 80*h*' and 80*l*', respectively, to permit them to be assembled into an annular cylinder or wheel, rollable along the upper surface of the mat, or into a semi-cylinder to be rockable on the mat, or to be disassembled for compact storage.

As indicated earlier, and as illustrated in the color illustration of FIG. 2, some or all of the play pieces, and the fastening elements on the playmat, may be of correspondingly different colors, such that the fastener elements on the playmat also indicate the proper play pieces to be releasably attached to the playmat at its respective location on the playmat.

The arrangement of play pieces illustrated in the drawings permits the child to use steps 72, 73 to reach the top of slide 71, then slide down the slide, and crawl through the tunnel 71*a* in slide 71, and over play pieces 74, 75, 76 and 77. Such an arrangement also permits the child to sit or stand on seat 79, to rock on the seat, and to play with various small play pieces (not shown), such as spheres, rollers, etc., confined within frame pieces 78. Further, it permits the child to use the balancing board 80, if desired, or to assemble it as a rollable wheel.

As indicated earlier, frame pieces 78, received on loop strips 311-341 of panel 30 define a border or fence for retaining a plurality of small play pieces (not shown) such as small spheres, rollers, blocks, or the like, on panel 30 which small play pieces may be included in the play system for playing by the child as the child sits on rockable seat 79. The frame play pieces 78 may also be applied for folding purposes on loop strips 551 of panel 50.

Figure 6A:
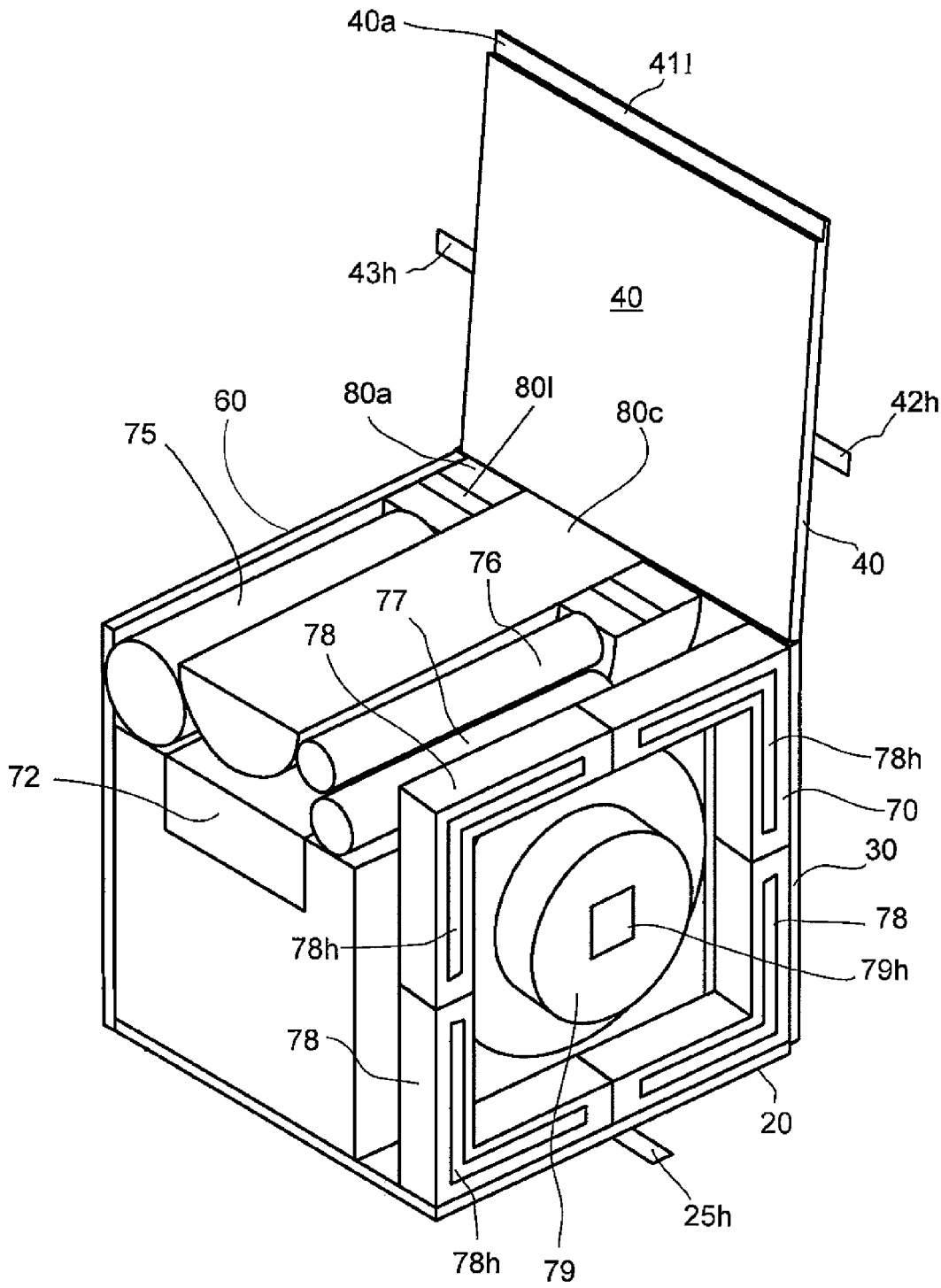
FIGS. 6*a*-6*c* illustrate different views of the play system of FIG. 5, with parts removed, to better show the respective positions of the play pieces within the playmat for compact storage or convenient transportation.
Figure 6B:
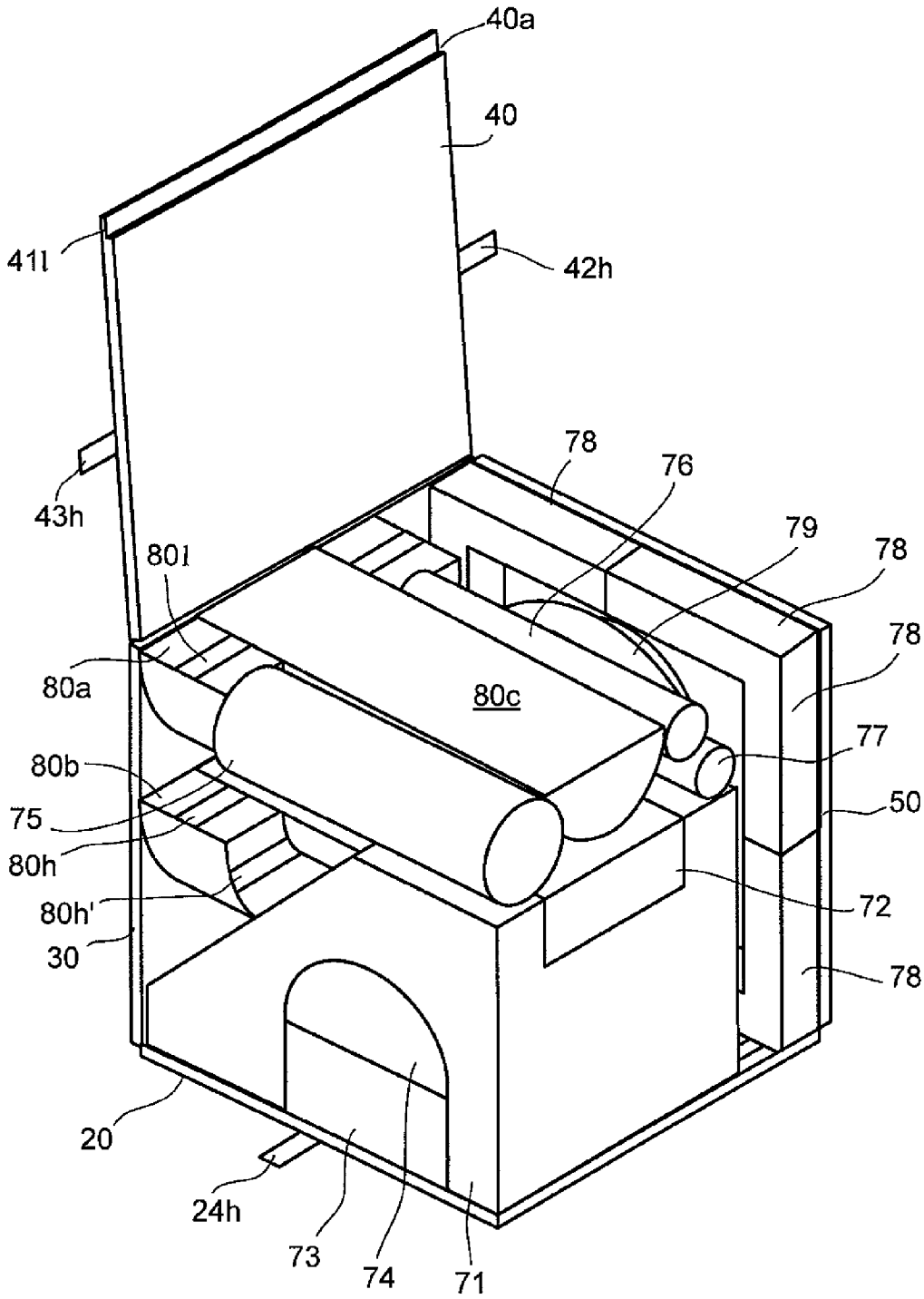
Figure 6C:
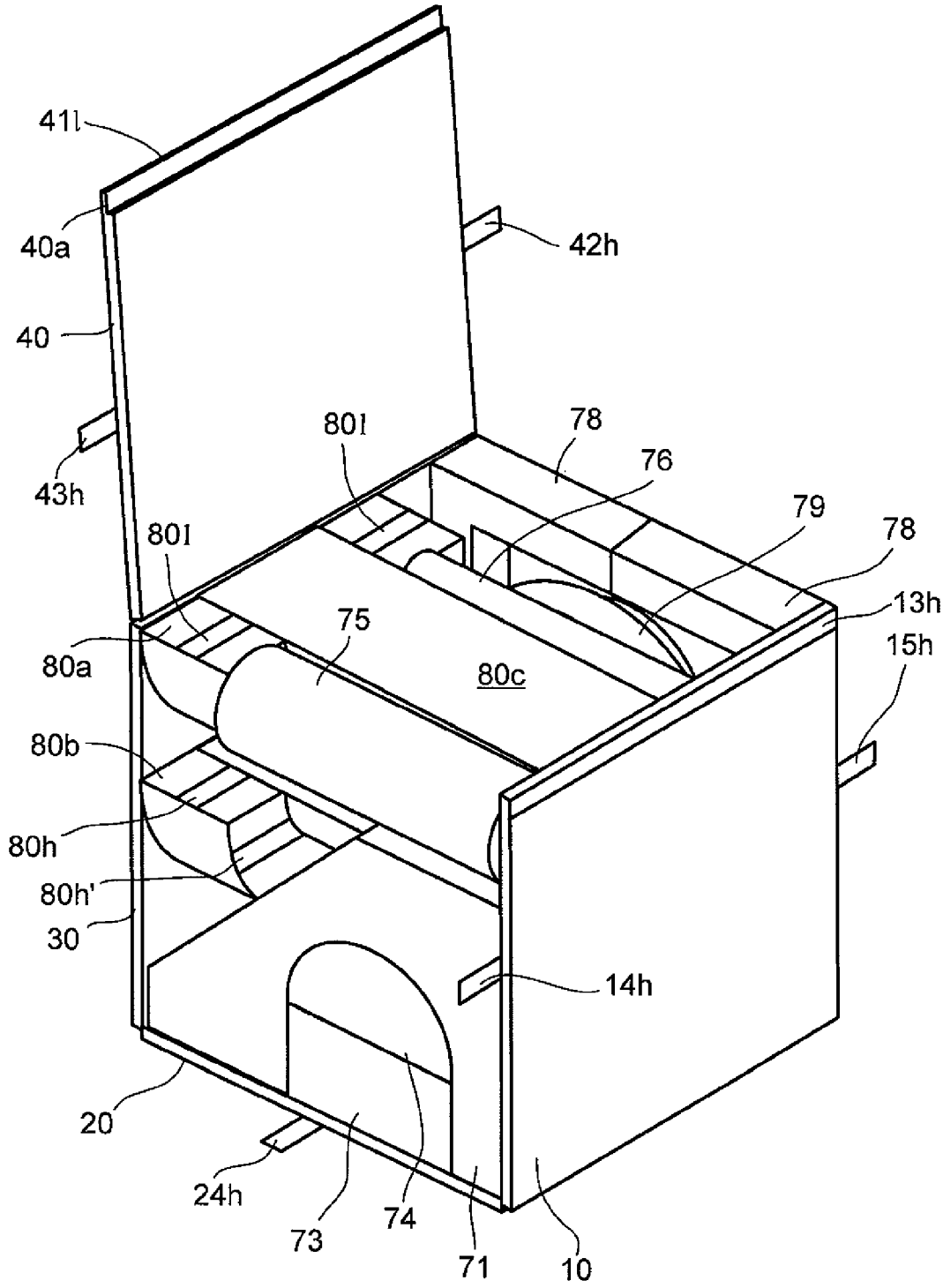

When the play system is to be dismantled and stored, the playmat may be folded to define a receptacle, and the play pieces may be introduced therein, as shown in FIGS. 6*a*-6*c*, to thereby store the playmat, as well as all the play pieces, in a single, compact unit convenient for handling by handles 59 and 69 for storage and for transportation.

When some or all of the play pieces have a color-coded relationship with respect to the mechanical fastener strips carried on the inner face of the playmat 2 as illustrated in FIG. 2, the color-coding facilitates locating and applying the respective play pieces in their proper positions on the playmat when in its open condition.

While the invention has been described with respect to one preferred embodiment, it will be appreciated that this is set forth merely for purposes of example, and that many variations, modifications and other applications of the invention may be made. For example, the playmat can be configured such that in its folded condition, it serves not only as a receptacle, but can also serve as a piece of furniture, such as a chair, or sofa, etc.

What is claimed is:

1. A play system for children, comprising:

a playmat having fold lines arranged to define a plurality of panels foldable from a flat condition for normal use as a playmat, to a folded condition defining a receptacle;

and a plurality of play pieces for use on the playmat when in its flat condition, and adapted to be received within the receptacle defined by the playmat when in its folded condition;

said playmat, and at least some of said play pieces, including mateable fastener elements for releasably retaining said play pieces on said playmat when in its flat condition;

the fastener elements on the playmat being located at preselected locations thereon to thereby locate and stabilize said play pieces carrying mateable fastener elements at said preselected locations;

wherein said plurality of panels include a first panel at an outer edge of the playmat and carrying fastener elements, and a second panel contiguous to, and inwardly of, said first panel;

and wherein said play pieces include a slide having a base carrying fastener elements mateable with said fastener elements on said second panel, a front wall perpendicular to said base to face, and to be engaged by said first panel in the folded condition of the playmat, a top wall, and a rear wall facing away from said first panel and inclined with respect to said face to serve as a slide in the flat condition of the playmat.

2. The play system according to claim 1, wherein said first panel also includes fastener elements; and wherein said play pieces further include blocks carrying fastener elements mateable with said first panel fastener elements to serve as steps for said slide in the flat condition of the playmat.

3. The play system according to claim 1, wherein said plurality of panels include a third panel in alignment with said first and second panels and contiguous to said second panel, said third panel also including fastener elements, and wherein said play pieces further include frame pieces carrying fastener elements mateable with said third panel fastener elements to serve as a frame for confining other, small, play pieces in the flat condition of the playmat.

4. The play system according to claim 3, wherein said plurality of panels include a fourth panel in alignment with said first, second and third panels, and contiguous to said third panel; and wherein said play pieces include cylindrical and/or semi-cylindrical play pieces receivable on said fourth panel for encouraging crawling or other body movements by the user in the flat condition of the mat.

5. The play system according to claim 4, wherein said plurality of panels include a fifth panel on one side of said third panel, said fifth panel including further fastener elements; and wherein said play pieces include a rocker seat having an upper section of circular configuration, and a base of smaller diameter than the upper section, the under face of said base including fastener elements mateable with said further fastener elements on said fifth panel.

6. The play system according to claim 5, wherein said upper section of the rocker seat is separable from said base, and wherein the undersurface of said upper section includes further fastener elements mateable with further fastener elements on the upper face of said base.

7. The play system according to claim 5, wherein said plurality of panels include a sixth panel on the side of said third panel opposite to that of said fifth panel; and wherein said playthings further include a balancing board dimensioned to be received on said sixth panel in the flat condition of the playmat.

8. The play system according to claim 7, wherein said balancing board include side sections of semi-cylindrical configuration so as to have rounded bottom surfaces for rockably engaging the playmat in its flat condition; and wherein the upper surfaces of said side sections are recessed to receive a third section to extend across two said side sections, said third section having a flat upper surface to support a user in a rockable manner in the flat condition of the playmat.

9. The play system according to claim 8, wherein the upper surfaces of said two semi-cylindrical side sections are flat and carry fastener elements which are mateable with respect to each other to enable the two semi-cylindrical side sections to be attachable together to define a cylindrical wheel.

10. The play system according to claim 1, wherein at least some of said play pieces are of different colors and at least some of the fastener elements on the playmat are of correspondingly different colors, such that the fastener elements on the playmat also indicate the proper playpiece to be releasably attached to the playmat at the respective location on the playmat.

11. The play system according to claim 1, wherein said fastener elements are hook-and-loop fastener elements.

12. The play system according to claim 11, wherein the hooks of the fastener elements are on the play pieces, and the loops of the fastener elements are on the playmat.

13. The play system according to claim 1, wherein the playmat is configured such that in its folded condition it defines a closed, six-sided receptacle.

14. A playmat constructed and dimensioned so as to be foldable from a flat condition for normal use as a mat, to a folded condition defining a receptacle;

and a plurality of play pieces for use on the playmat when in its flat condition, and adapted to be received within the receptacle defined by the playmat when in its folded condition;

said playmat, and at least some of said play pieces, including mateable fastener elements for releasably retaining said play pieces on said playmat when in its flat condition;

the fastener elements on the playmat being located at preselected locations thereon to thereby locate and stabilize said play pieces carrying mateable fastener elements at said preselected locations;

wherein said panels includes a rocker seat panel having further fastener elements; and wherein said play pieces include a rocker seat having an upper section of circular configuration, and a base of smaller diameter than the upper section, the under face of said base including further fastener elements mateable with said further fastener elements on the rocker panel in the flat condition of the playmat.

15. The play system according to claim 14, wherein said upper section of the rocker seat is separable from said base, and wherein the undersurface of the upper section includes further fastener elements mateable with further fastener elements on the upper face of said base.

16. The play system according to claim 14, wherein:

said playmat includes first, second, third and fourth panels in a linear array, and fifth and sixth panels on opposite sides of said third panel, in the flat condition of the playmat, said fifth panel being the one having fastener elements for receiving said rocker seat;

wherein said first and second panels include further fastener elements;

and wherein said play pieces include a slide having a base carrying fastener elements mateable with said fastener elements on said second panel, a front wall perpendicular to said base to face, and to be engaged by, said first panel in the folded condition of the playmat, a top wall, and a rear wall facing away from said first panel and inclined with respect to said base to serve as a slide in the flat condition of the playmat.

17. The play system according to claim 16, wherein said first panel also includes fastener elements; and wherein said play pieces further include blocks carrying fastener elements mateable with said first panel fastener elements to serve as steps for said slide in the flat condition of the playmat.

18. The play system according to claim 16, wherein said playmat includes a third panel in alignment with said first and second panels and contiguous to said second panel, said third panel also including fastener elements, and wherein said play pieces further include frame pieces carrying fastener elements mateable with said third panel fastener elements to serve as a frame for confining other, small, play pieces in the flat condition of the playmat.

19. The play system according to claim 18, wherein said playmat includes a fourth panel in alignment with said first, second and third panels, and contiguous to said third panel; and wherein said play pieces include cylindrical and/or semi-cylindrical play pieces receivable on said fourth panel for encouraging crawling or other body movements by the user in the flat condition of the mat.

20. The play system according to claim 16, wherein said playmat includes a sixth panel on the side of said third panel opposite to that of said fifth panel; and wherein said playthings further include a balancing board dimensioned to be received on said sixth panel in the flat condition of the playmat.

* * * * *